US006706297B1

(12) United States Patent
Toth et al.

(10) Patent No.: US 6,706,297 B1
(45) Date of Patent: Mar. 16, 2004

(54) ATTACHABLE SNACK FOOD CONTAINER

(75) Inventors: Mary K. Toth, Maple Grove, MN (US); Arne H. Brauner, Minnetonka, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/483,039

(22) Filed: Jan. 18, 2000

(51) Int. Cl.[7] ..... B65D 6/00; B65D 21/02

(52) U.S. Cl. ..... 426/120; 426/85; 426/115; 206/541; 206/223; 220/521; 220/212; 220/710

(58) Field of Search ..... 426/120, 115, 426/112, 85, 86; 206/541, 514, 223; 220/4.03, 503, 505, 529, 710, 709, 705, 23.83, 737, 521, 524, 212

(56) References Cited

U.S. PATENT DOCUMENTS 1,064,442 A * 6/1913 Cadigan ..... 426/115
3,730,737 A * 5/1973 Harvey et al. ..... 99/171
4,823,958 A 4/1989 Mahmud
4,883,935 A 11/1989 Fairchild et al.
5,085,330 A * 2/1992 Paulin ..... 426/120
5,180,079 A 1/1993 Jeng
5,310,072 A 5/1994 Matusovsky et al.
5,318,787 A * 6/1994 Brauner et al. ..... 426/115
5,573,131 A 11/1996 Berjis
5,922,376 A * 7/1999 Privert ..... 426/115

OTHER PUBLICATIONS

WO 99/26847 (Ferraro et al), Jun. 3, 1999.*

* cited by examiner

*Primary Examiner*—Reginald L. Alexander
(74) *Attorney, Agent, or Firm*—John A. O'Toole; Douglas J. Taylor; Timothy A. Czaja

(57) ABSTRACT

A snack food container for containing a snack food product. The snack food container includes a side wall, a bottom wall and a flange body. The side wall forms an upper opening. The bottom wall is connected to the side wall opposite the upper opening. The flange body extends downwardly from the bottom wall and defines an inner surface and an outer surface. The inner surface is configured for selective attachment to a separate beverage container. Finally, the snack food container defines an internal storage region for containing a snack food product. During use, the snack food container is assembled to a separate beverage container via the inner surface of the flange body. With this configuration, the snack food container can be used in conjunction with a beverage container for "on-the-go" storage and consumption.

48 Claims, 5 Drawing Sheets

ATTACHABLE SNACK FOOD CONTAINER

BACKGROUND OF THE INVENTION

The present invention relates to a snack food container. More particularly, it relates to a snack food container configured for convenient attachment to a separate beverage container.

A wide variety of consumable items are provided in convenient, single serving packages or containers. These items range from beverage products, such as soda pop and juice, to solid snack food items such as crackers, potato chips, etc. The packaging associated with each product is directly related to the particular product's form. For example, due to their liquid nature, beverage products are normally packaged in rigid canisters (e.g., aluminum cans, plastic or glass bottles, etc.). Conversely, solid snack food items are typically sold to consumers in less expensive plastic or foil bags. Regardless of exact form, consumers highly desire the convenience associated with single serving products as they can be easily transported from one location to another for "on-the-go" consumption.

Single serving packages or containers have become overwhelmingly popular. In fact, the popularity of single serving beverage containers has prompted manufactures of other products to incorporate devices for accommodating single serving beverage containers. For example, most newer automobiles include one or more cup holders sized to maintain a beverage container. The cup holder provides a convenient location for temporarily storing an open beverage container without fear of accidental spillage. A consumer can advantageously consume the beverage while travelling (or "on-the-go"), storing the beverage container within arm's reach in the cup holder between drinks. Cup holders are likewise utilized with boats, movie theater seats, stadium seats, etc.

Cup holder utility is premised upon the fact that beverage containers are normally cylindrical and rigid. For example, a popular beverage container is a rigid, 12-ounce (355 mL) aluminum can. Other configurations, such as plastic or glass bottles, are similarly rigid. This construction is highly conducive to upright storage within a cup holder. Unfortunately, the irregular shape and flexible nature of snack food bags do not allow for this same convenient storage. That is to say, cup holders are not sized to easily receive and/or maintain a bag of snack food product. Further, because snack food bags are not rigid, they cannot readily be maintained upright. Notably, even if upright storage within a cup holder were possible, often times a consumer will desire to consume both a beverage and a snack food product when traveling, attending an event, etc. Under these circumstances, the consumer will undoubtedly choose to place the beverage container within the cup holder. When occupied by a beverage container, the cup holder is unavailable for snack food product storage. Instead, the consumer must lay the snack food product on his or her lap, rendering consumption of the snack food difficult. Pointedly, this scenario increases the opportunity for accidental snack food product spillage.

Consumers may be able to overcome some of the above-described problems associated with "on-the-go" consumption of snack food products by filling a small container with the desired snack food product prior to travelling. This approach is highly inconvenient, and may not be available where the snack food is purchased during the trip itself (e.g., purchased at a gas station). Further, the cup holder associated with the consumer's vehicle may not be sized to maintain the container and/or the cup holder may be occupied by a beverage container. As a result, the consumer is once again forced to hold the snack food product on his or her lap.

Consumers continue to demand convenient, single serving snack food products. Due to the highly competitive nature of the snack food industry, any efforts to provide a packaging configuration able to overcome the above-described consumption problems on a cost effective basis will likely provide a distinct competitive advantage. Therefore, a need exists for a snack food container configured for convenient on-the-go storage and consumption.

SUMMARY OF THE INVENTION

One aspect of the present invention provides a snack food container including a side wall, a bottom wall and a flange body. The side wall forms an upper opening. The bottom wall is connected to the side wall opposite the upper opening. The flange body extends downwardly from the bottom wall and defines an inner surface and an outer surface. The inner surface is configured for selective attachment to a beverage container. With this configuration, the snack food container defines an internal storage region for containing a snack food product. Prior to use, a snack food product is placed within the internal storage region. The snack food container is then attached to a top portion of a beverage container via the inner surface of the flange. Once attached, the snack food container is maintained upright by the beverage container for convenient consumption of the snack food product. In one preferred embodiment, the inner surface of the flange body is substantially annular for attachment to a cylindrical beverage container. In another preferred embodiment, the snack food container forms a slot for providing convenient access to an opening in the beverage container.

Another aspect of the present invention relates to a packaged good article. The packaged good article includes a snack food container and a snack food product. The snack food container includes a side wall, a bottom wall and a flange body. The side wall forms an upper opening. The bottom wall is connected to the side wall opposite the upper opening. The flange body extends downwardly from the bottom wall and defines an inner surface and an outer surface. The inner surface is configured for selective attachment to a separate beverage container. Finally, the snack food container defines an internal storage region within which the snack food product is contained. During use, the packaged good article is attached to a separate beverage container via the inner surface of the flange body. Where applicable, the beverage container may, in turn, be maintained within a cup holder of a vehicle. Regardless, interaction between the inner surface of the flange body and the beverage container maintains the packaged good article in an upright position. As a result, the snack food product can conveniently be consumed from the snack food container. In one preferred embodiment, the snack food container forms a slot extending from the side wall to the bottom wall.

Yet another aspect of the present invention relates to a snack food container including a side wall, a bottom wall, a flange body and a retaining means. The side wall forms an upper opening. The bottom wall is connected to the side wall opposite the upper opening. The flange body extends downwardly from the bottom wall. The retaining means is configured for selectively attaching the snack food container to a separate beverage container. The side wall, the bottom wall, the flange body and the retaining means are integrally formed. With this configuration, the snack food container forms an internal storage region for containing a snack food product. During use, the snack food container is attached to a separate beverage container via the retaining means for convenient consumption of a snack food product contained within the internal storage region.

DESCRIPTION OF THE PREFERRED EMBODIMENTS

Figure 1:
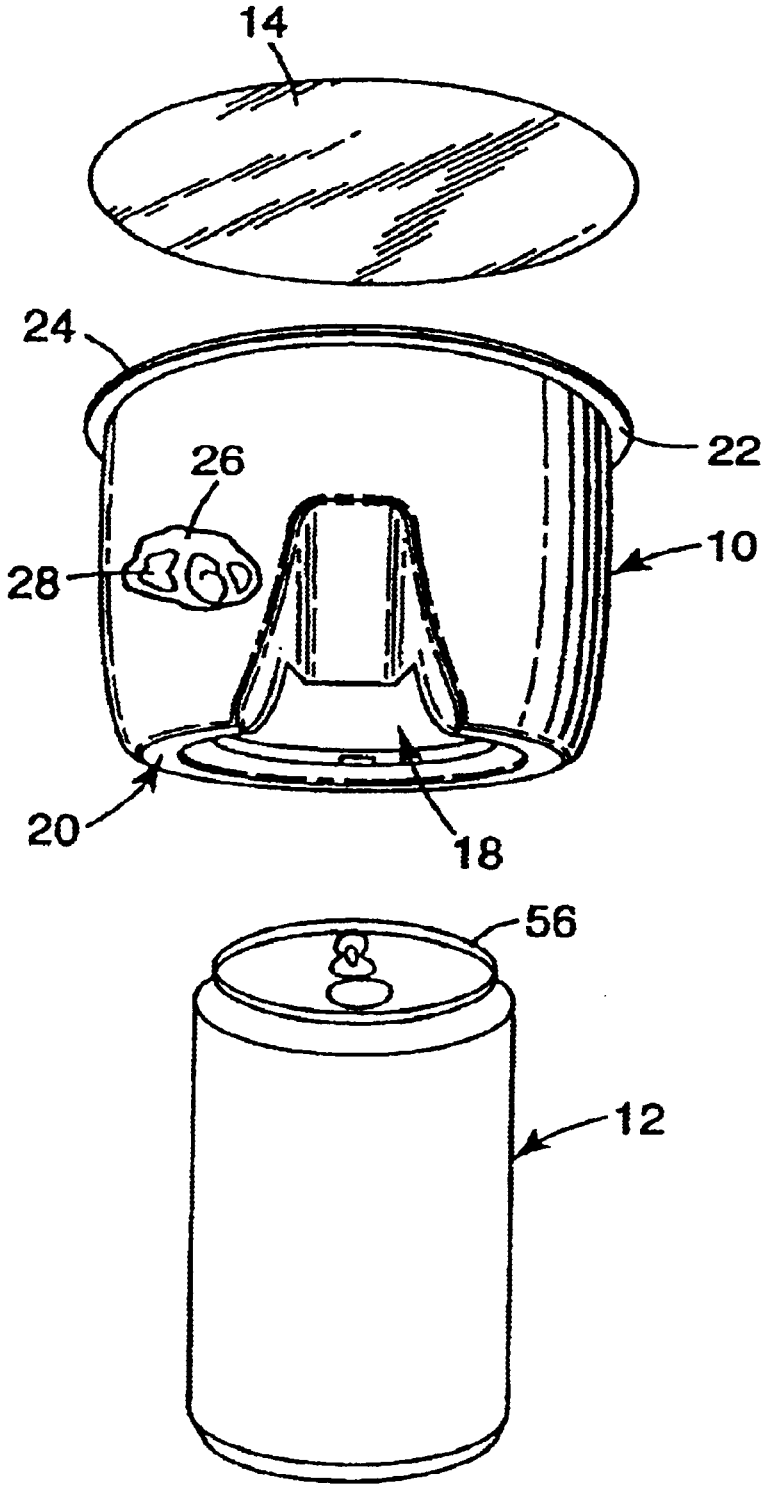
FIG. 1 is a perspective, exploded view of a snack food container in accordance with the present invention, shown in conjunction with a separate beverage container.

One preferred embodiment of a snack food container 10 is shown in FIG. 1. As a point of reference, the snack food container 10 is shown in conjunction with a separate beverage container 12. As described in greater detail below, the beverage container 12 can assume of a wide variety of forms and is depicted in FIG. 1 as being a known 12-ounce (355 mL) aluminum can. Regardless, the beverage container 12 is readily available and has known, pre-determined dimensions. With this in mind, the snack food container 10 is configured for selective attachment to the beverage container 12. The snack food container 10 is generally formed as a bowl and preferably includes a protective film 14, a side wall 16, a bottom wall 18 (shown partially in FIG. 1) and a flange body 20. The side wall 16 forms a lip or flange 22 about an open end 24. The-lip 22 is configured to receive the protective film 14. The bottom wall 18 is connected to the side wall 16 opposite the open end 24. The flange body 20 extends downwardly from the bottom wall 18. Finally, the snack food container 10 forms an internal storage region 26 (shown partially in FIG. 1)) within which a snack food product 28 is contained. Notably, directional terminology, such as "upper," and "lower," "top" and "bottom" are used for purposes of illustration only and with reference to a desired upright orientation of the snack food container 10 as shown in FIG. 1. However, the snack food container 10 can be positioned in other orientations such that the directional terminology is in no way limiting.

One function of the protective film 14 is to provide a sanitary seal for the snack food product 28 contained within the snack food container 10. Thus, the protective film 14 is preferably shaped in accordance with the upper opening 24. In the embodiment shown in FIG. 1 where the upper opening 24 is generally circular, the protective film 14 is likewise circular in shape. While a wide variety of film materials can be used for the protective film 14, the material selected preferably is approved for contact with food and provides a contaminant barrier. In one preferred embodiment, the protective film 14 is metalized film or foil as known in the art. Alternatively, the protective film 14 is formed from a polymer such as polyethylene, polypropylene, PET, polystyrene, etc. Additionally, the protective film 14 may include indicia (not shown), such as a manufacturer trademark or trade name, product description, etc. Finally, while the protective film 14 does serve to maintain integrity of the snack food product 28, the protective film 14 is not a necessary element of the present invention. In other words, the snack food container 10 will function without the protective film 14.

Figure 2:
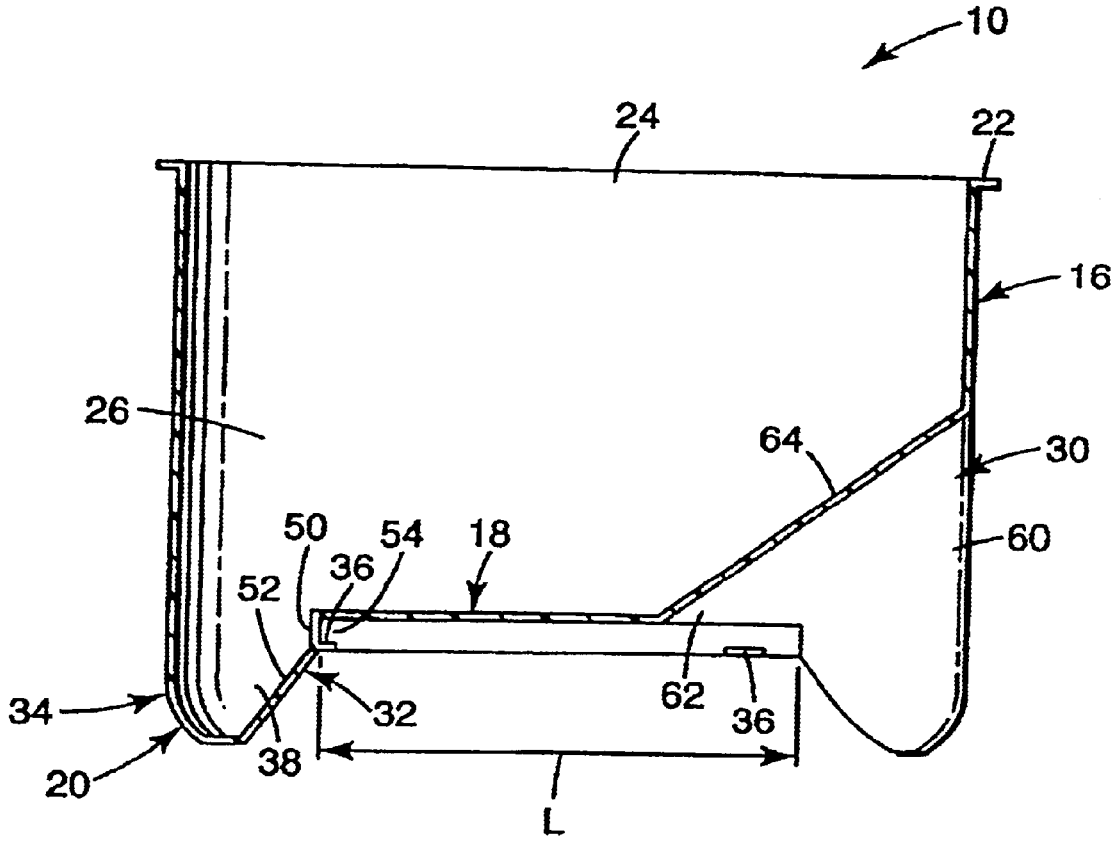
FIG. 2 is a side, cross-sectional view of the snack food container of FIG. 1.

The snack food container 10 is shown in greater detail in FIG. 2. For purposes of illustration, the snack food container 10 is depicted in FIG. 2 with the protective film 14 (FIG. 1) removed. The snack food container 10 is shown in FIG. 2 as including the side wall 16, the bottom wall 18, the flange body 20 and a slot 30.

The side wall 16 is preferably generally frusto-conical in shape, although other shapes such as cylindrical, triangular, square, etc. are equally acceptable. Even further, the side wall 16 may be irregularly shaped. In this regard, the side wall 16 is preferably integrally formed, but can instead be formed by a plurality of separate sections or panels that are assembled to one another. Regardless, the side wall 16 forms an outer portion of the internal storage region 26.

The lip 22 is formed as a radial extension of the side wall 16, preferably circumscribing the upper opening 24. The lip 22 is preferably sized to provide an adequate surface area for receiving the protective film 14 (FIG. 1). Where the protective film 14 is not employed, however, it will be recognized that the lip 22 can likewise be eliminated.

The bottom wall 18 is shown in FIG. 2 as being preferably horizontal when the snack food container 10 is upright. As previously described, the bottom wall 18 is centrally formed opposite the upper opening 24 and is connected to the side wall 16 via the flange body 20. Alternatively, however, the bottom wall 18 can be connected to the side wall 16 apart from the flange body 20. Regardless, the bottom wall 18 defines at least a portion of the internal storage region 26.

The flange body 20 extends downwardly from the bottom wall 18 and includes an inner surface 32, an outer surface 34 and a plurality of retention tabs 36. In one preferred embodiment, the inner surface 32 and the outer surface 34 are spaced from one another such that the flange body 20 forms a portion 38 of the internal storage region 26. Alternatively, however, the inner surface 32 and the outer surface 34 can be formed by a single wall, thereby eliminating the portion 38. Regardless, the retention tabs 36 extend in a generally radial fashion from the inner surface 32 and are configured to selectively couple the flange body 18 to the beverage container 12 (FIG. 1) as described in greater detail below.

Figure 3:
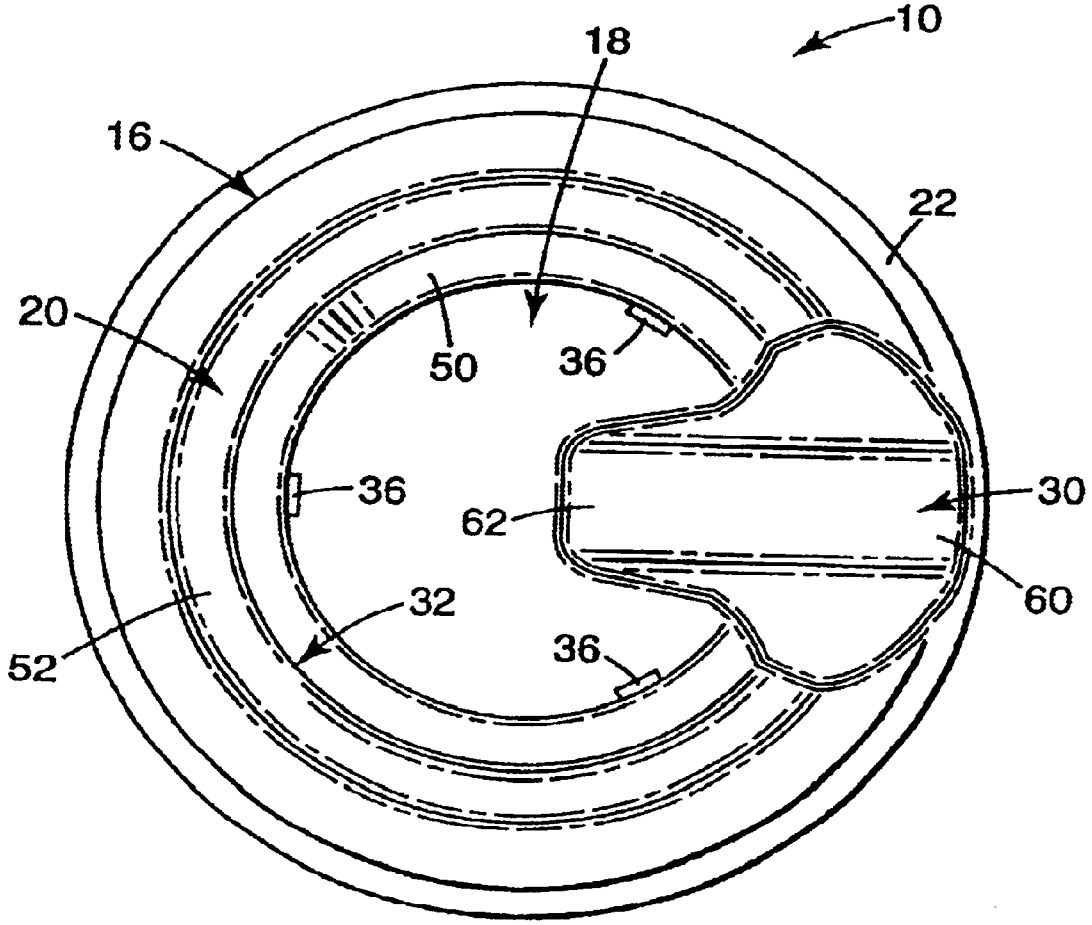
FIG. 3 is a bottom, elevational view of the snack food container of FIG. 1.

The inner surface 32 is preferably substantially annular in form, as shown in FIGS. 2 and 3. This preferred annular construction corresponds with a circular shape found with many available beverage containers (such as, for example, the beverage container 10 shown in FIG. 1). Alternatively, where the snack food container 12 is intended for use with a differently shaped beverage container (such as, for example, a rectangularly-shaped fruit drink box known in the art), the shape of the inner surface 32 will be altered accordingly. It should be further noted from FIGS. 2 and 3 that the inner surface 32 preferably does not form a continuous, closed perimeter due to implementation of the slot 30, described below. Nonetheless, the inner surface 32 preferably forms a substantially closed perimeter to ensure adequate surface area interaction between the inner surface 32 and the beverage container 12 (FIG. 1). For example, with the preferred substantially annular structure, the inner surface 32 referably defines an arc length of at least 180°, more preferably at least 270° In an alternative embodiment, the slot 30 can be formed so as to not extend through the flange body 20 or can be eliminated, such that the inner surface 32 forms a continuous, closed perimeter.

In one preferred embodiment, the inner surface 32 includes a first section 50 and a second section 52. The first section 50 extends from the bottom wall 18. In the preferred, upright orientation of the snack food container 10, the first section 50 is substantially vertical. As described in greater below, this vertical configuration facilitates a desired frictional interaction between the first section 50 and a corresponding top portion of the beverage container 12 (FIG. 1). With most applications, the beverage container 12 has a circular top. As such, the first section 50 is similarly circular or annular. Further, the top portion of the beverage container 12 will have a known, predetermined diameter. Because the first section 50 is preferably configured to engage the beverage container 12, the first section 50 preferably has a diameter approximating the predetermined diameter of the beverage container 12. In one preferred embodiment, the first section 50 defines a diameter in the range of approximately 52–55 mm; most preferably 53 mm. Alternatively, depending upon the particular configuration of the beverage container 12, the first section 50 can assume other diameters. Even further, the first section 50 need not necessarily be circular, but can assume other shapes commensurate with a shape of the beverage container 12, such as rectangular.

The second section 52 extends downwardly from first section 50, preferably expanding in diameter. With this configuration, the second section 52 acts as a guide surface for directing the first section 50 into engagement with the beverage container 12 (FIG. 1). Alternatively and/or in addition, a shape defined by the second section 52 corresponds with a shape of the upper portion of the beverage container 12. For example, in one preferred embodiment, the beverage container 12 is a standard 12-ounce (355 mL) aluminum can, the upper portion of which tapers in outer diameter. Where the snack food product container 10 is intended for use with a so-configured beverage container 12, the second section 52 corresponds in shape.

The retention tabs 36 preferably extend in a generally radial fashion from the first section 50 as shown in FIG. 2. For example, in one preferred embodiment, each of the retention tabs 36 has a radial width or extension of approximately 1 mm, although other dimensions are acceptable. Further, each of the retention tabs 36 is preferably axially spaced from the bottom wall 18. For example, in one preferred embodiment, each of the retention tabs 36 is axially spaced from the bottom wall 18 by approximately 4 mm. This preferred axial spacing generates a receiving zone 54 between the retention tabs 36 and the bottom wall 18. In one preferred embodiment, the receiving zone 54 corresponds in axial height with a rim formed by the beverage container 12 (shown as the rim 56 in FIG. 1), such that the receiving zone 54 selectively maintains the rim 56 via an interference fit. With this in mind, an axial spacing of the retention tabs 36 relative to the bottom wall 18 can be altered in accordance with a configuration of the available beverage container 12 to which the snack food container 10 is to be attached. Alternatively, the retention tabs 36 can be configured to frictionally engage the beverage container 12. As best shown in FIG. 3, in one preferred embodiment, three, equidistantly spaced retention tabs 36 are provided. Alternatively, any other number and/or spacing can be employed. Even further, in an alternative embodiment, a frictional fit between the inner surface 32 and the beverage container 12 can be relied upon for selective attachment, such that the retention tabs 36 can be eliminated.

The slot 30 is best shown with reference to FIGS. 2 and 3. The slot 30 preferably extends from the side wall 16 to the bottom wall 18, passing through the flange body 20. With this configuration, the slot 30 defines an open portion 60 along the side wall 16 and an open portion 62 along the bottom wall 18, thereby providing access to regions below the bottom wall 18 from a point exterior the side wall 16. As described in greater detail below, the slot 30 is sized to facilitate passage of a drinking device, such as a straw, as well as in accordance with an opening in the beverage container 12 (FIG. 1). With this in mind, the slot 30 preferably has a width of at least 10 mm; more preferably at least 15 mm.

As best shown in FIG. 2, the slot 30 is defined in part by a slot wall 64 extending in a generally angular fashion from the bottom wall 18 to the side wall 16. In one preferred embodiment, the slot wall 64 forms an angle with the bottom wall 18 in the range of approximately 20–45°, more preferably 30°. It should be recognized that extension of the slot wall 64 reduces an available volume of the internal storage region 26. Therefore, it is preferred that the slot 30 not extend to the lip 22 of the side wall 16. In other words, the slot 64 preferably terminates along the side wall 16 at a point spaced from the lip 22 (or the upper opening 24). In one preferred embodiment, the slot wall 64 spaced from the lip 22 by a dimension in the range of approximately 20–40 mm, more preferably approximately 33 mm, although other locations are equally acceptable.

Termination of the slot wall 64 relative to the bottom wall 18 is dictated, in large part, by a configuration of the beverage container (for example the beverage container 12 shown in FIG. 1) to which the snack food container 10 is to be attached. In particular, the slot 30 is configured to provide access to an opening in the beverage container 12, as described below. A countervailing constraint resides in the fact that extension of the slot wall 64 relative to the bottom wall 18 reduces an available volume of the internal storage region 26. Thus, in one preferred embodiment, where the bottom wall 18 has a length (or diameter) L, the slot wall 64 terminates at a location approximately ⅓ the length L. Other configurations are equally acceptable, such that the slot wall 64 can approximately bisect the bottom wall 18 or extend to a distance approximating ⅔ L or greater.

Finally, for ease of manufacture, the slot 30 preferably extends through the flange body 20, as best shown in FIG. 3. With this configuration, the inner surface 32 preferably does not form a continuous perimeter, as previously described circle and as shown in FIG. 3. Instead, the inner surface 32 is open at the slot 30. Alternatively, however, the flange body 20 may be left at least partially intact, thereby encompassing the slot 30.

The snack food container 10, including the side wall 16, the bottom wall 18 and the flange body 20, is preferably integrally formed from a plastic material. Because the snack food container 10 is in direct contact with food, a material approved for food contact should be employed, as is well known in the art. Further, the skilled artisan will appreciate that in other variations, the snack food container 10 can be fabricated such that the side wall 16, the bottom wall 18 and/or the flange body 20 are separately formed and subsequently assembled. The snack food container 10 is preferably thermoformed from a flat sheet. Alternatively, plastic injection or blow molding techniques can be employed. Regardless of the exact manufacturing approach, the snack food container 10 provides the internal storage region 26 having a volume sufficient to store an appropriate volume of the snack food product 28 (FIG. 1). In one preferred embodiment, the internal storage region 26 has a volume of approximately 300 mL, although other volumes are equally acceptable.

By employing a material approved for contact with food, the snack food container 10 can be used to maintain a wide variety of different snack food products. For example, the snack food product 28 can be a dry food product, such as a crackers, crispy corn snacks, snack chips, pretzels, potato chips, popcorn, small cookies, cereal-based products (e.g., formed form wheat, oats, or rice), etc. Even further, other commonly available snack food items such as fruit snacks, nuts, etc. can be used as the snack food product 20.

Figure 4:
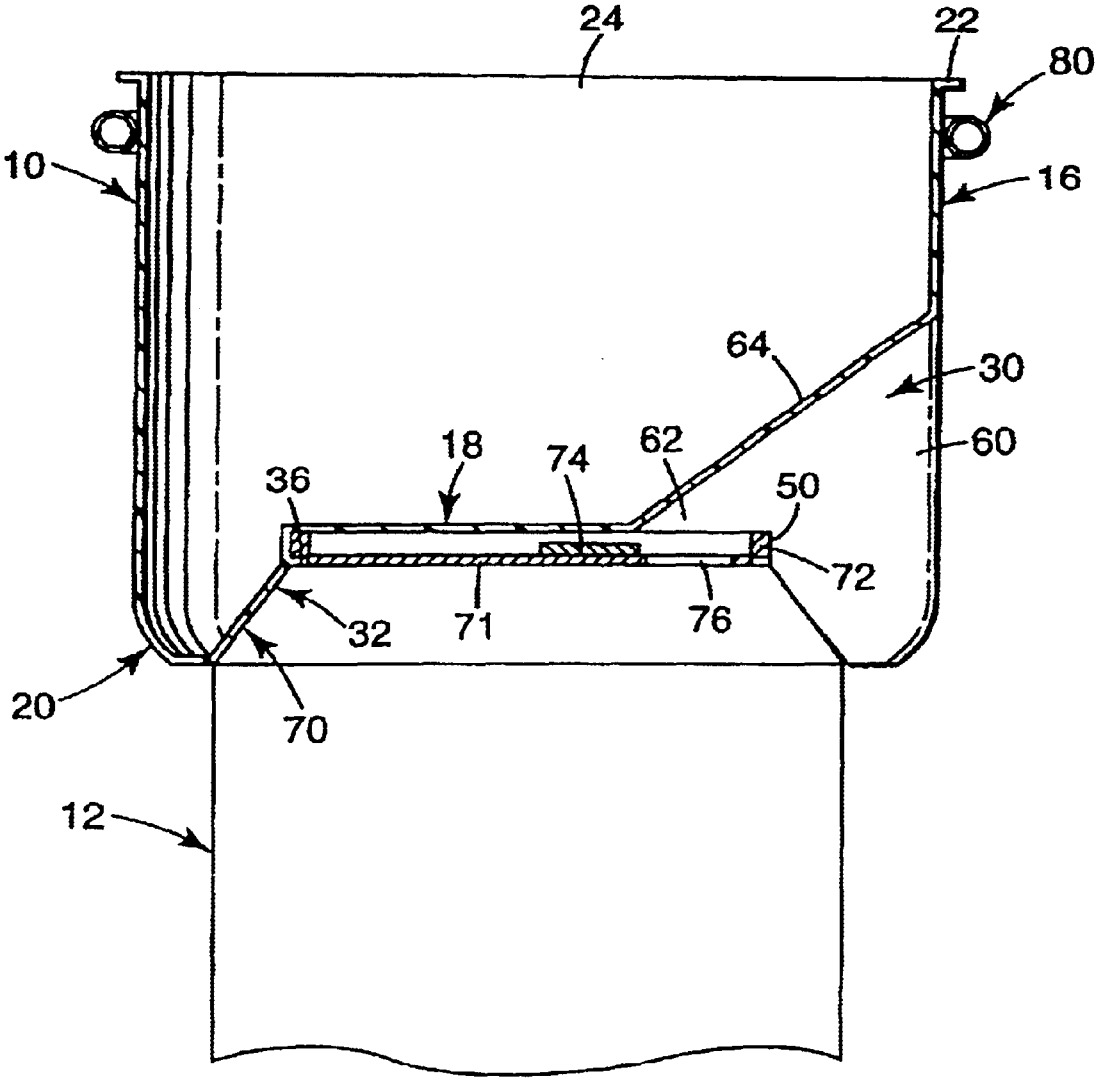
FIG. 4 is a cross-sectional view of a snack food container in accordance with the present invention assembled to a separate beverage container.

During use, the snack food container 10 is assembled to the beverage container 12 as shown in FIG. 4. As a point of reference, the beverage container 12 can assume a wide variety of "standard" forms, for example, a cylindrical metal can, a glass or plastic bottle, a plastic drink box, etc. However, in one preferred embodiment, the beverage container 12 is a "standard" 12-ounce (355 mL) aluminum can having a tapered top portion 70 terminating a top panel 71 and in a rim 72. The so-configured beverage container 12 typically further includes a pull tab 74 used to open a passage 76 in the top panel 71. The pull tab design is well-known in the art. In fact, beverage containers 12 having the configuration shown in FIG. 4 are essentially standardized such that regardless of manufacturer, the top portion 70, including the top panel 71 and the rim 72, will have a predetermined, known diameter.

Prior to assembly of the snack food container 10, the passage 76 is opened via the pull tab 74. The snack food container 10 is then directed downwardly toward the top portion 70. The flange body 20, and in particular the second section 52 of the inner surface 32, guides the inner surface 32 over the top portion 70. Further downward movement of the snack food container 10 relative to the beverage container 12 causes the retention tabs 36 to slide over the rim 72 such that the rim 72 is engaged within the receiving zone 54. In one preferred embodiment, the first section 50 of the inner surface 32 has a diameter approximating a diameter of the rim 72 such that the rim 72 at least partially is frictionally engaged by the inner surface 32. Interaction between the inner surface 32 and the top portion 70 of the beverage container 12 further supports coupling engagement of the rim 72 within the receiving zone 54 defined by the retention tabs 36. Alternatively, or in addition, other retaining bodies may be employed apart from the retention tabs 36. For example, an o-ring design, clips, etc. can be use. Even further, a frictional fit may provide sufficient coupling.

Once assembled, the snack food container 10 can be rotated relative to the beverage container 12 such that the slot 30, and in particular the open portion 62, is aligned with the passage 76. A consumer can then access the passage 76 (and thus the contents the beverage container 12) from a point exterior of the side wall 16 via the slot 30. For example, a straw 80 may be provided with the snack food container 10 such as by releasably adhering the straw 80 to the side wall 16 as shown in FIG. 4, where the straw 80 is formed to be bendable. With this configuration, the straw 80 is removed from the side wall 16 and then inserted through the slot 30 and the passage 76, and into the beverage container 12.

Figure 5:
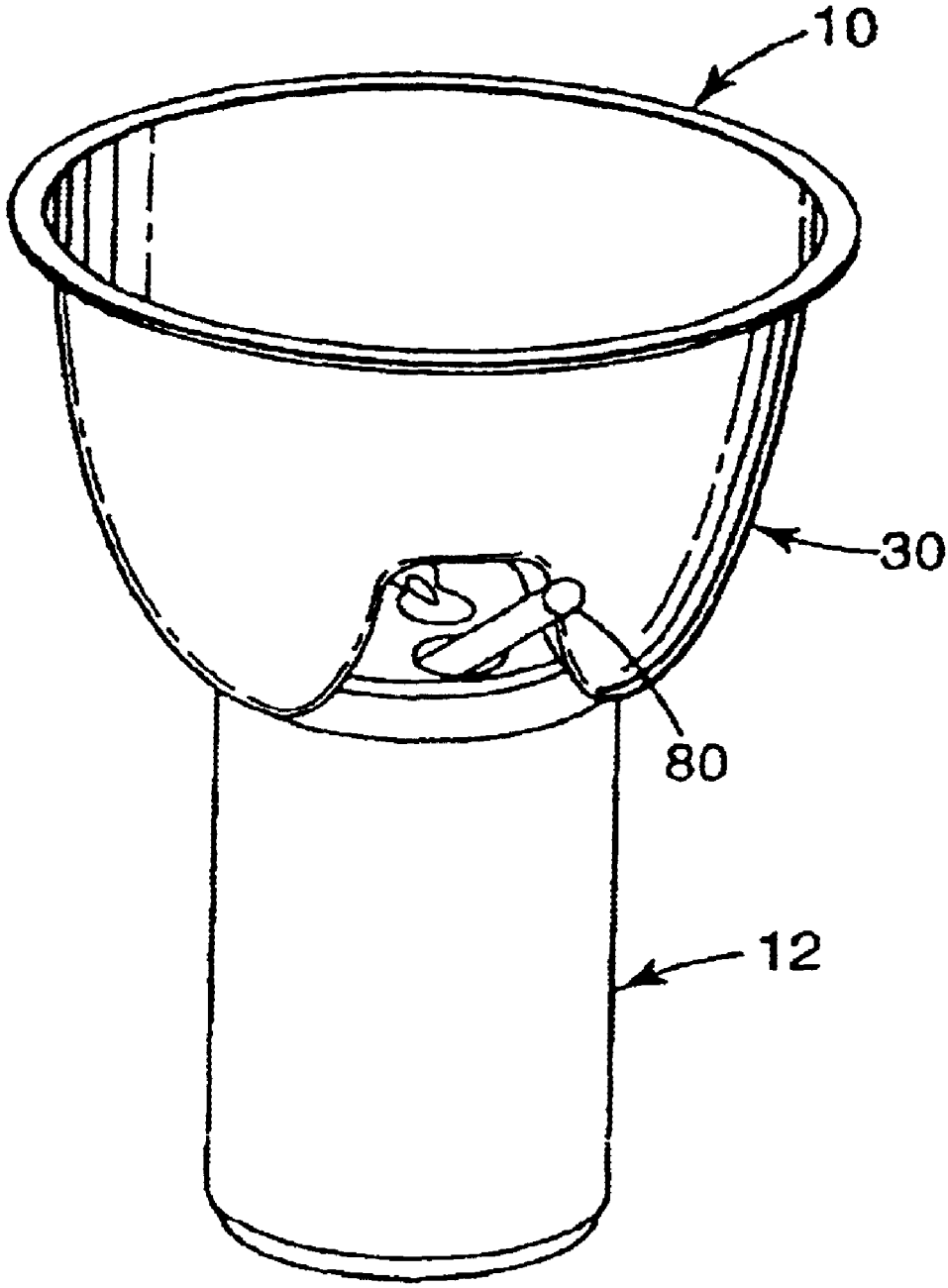
FIG. 5 is a perspective view of a snack food container in accordance with the present invention assembled to a separate beverage container and shown in conjunction with a straw.

Final assembly of the snack food container 10 to the separate beverage container 12, including the straw 80, is shown in FIG. 5. It should be understood that the straw 80 need not necessarily be provided with the snack food container 10, but instead can be independently provided by the consumer. Regardless, once assembled, the protective film 14 (FIG. 1) is removed from the lip 22 such that the consumer (not shown) can consume the snack food product 28 (FIG. 1). Similarly, the user can consume contents of the beverage container 12 via the straw 80. Further, where the consumer intends to consume contents of the snack food container 10 and/or the beverage container 12 while traveling (such as in an automobile), the beverage container 12 serves as a base for the snack food container 10. In other words, the beverage container 12 can be placed within a separate cup holder (not shown). The cup holder serves to support and maintain the beverage container 12 in an upright position. The beverage container 12, in turn, serves to maintain the snack food container 10 in an upright orientation. Thus, the consumer is not required to hold the snack food container 10 in his or her lap. The combination snack food container 10/beverage container 12 can easily and repeatedly be removed from the cup holder for consumption with minimal, if any, spillage. Notably, as best shown in FIG. 5, the slot 30 preferably expands in width along the flange body 20. With this increased width, the slot 30 can accommodate a wide variety of differently sized passages 76.

The snack food container of the present invention provides a marked improvement over previous designs. The snack food container is preferably integrally formed from a plastic material and is therefore relatively inexpensive, Further, by providing the snack food container with a flange body configured to engage an available beverage container, the snack food container can be used in conjunction with available beverage containers for "on-the-go" consumption. In fact, the food container can be sold by retailers in conjunction with various beverages, using the combinable packages for purchasing enticement.

Although the present invention has been described with reference to preferred embodiments, workers skilled in the art will recognize the changes may be made in form and detail without departing from the spirit and scope of the present invention. For example, the snack food container has been described with reference to an available 12-ounce aluminum can. A wide variety of other beverage containers are readily available, such as large-mouthed bottles, drink boxes, etc. For each of these applications, the flange body, and in particular the inner surface, can be configured accordingly such that the snack food container is selectively attachable to the particular beverage container. Further, the slot can be eliminated from the snack food container design, such that the snack food container is repeatedly removed form the beverage container for beverage consumption.

What is claimed is:

1. A snack food container comprising:

a side wall forming an upper opening;

a bottom wall connected to the side wall opposite the upper opening; and a flange body extending downwardly from the bottom wall, the flange body defining an inner surface and an outer surface, the inner surface being configured for selective attachment to a beverage container and characterized by the absence of threads;

wherein the side wall and the bottom wall define an internal storage region for containing a snack food product, the internal storage region being formed apart from the inner surface of the flange body.

2. The snack food container of claim 1, wherein the inner surface of the flange body is sized in accordance with a top portion of an available beverage container having a predetermined outer dimension.

3. The snack food container of claim 2, wherein the available beverage container is cylindrical such that the predetermined outer dimension is a diameter.

4. The snack food container of claim 3, wherein the inner surface is substantially annular.

5. The snack food container of claim 3, wherein the inner surface includes a receiving section for interfacing with a top portion of the beverage container, the receiving section defining a diameter slightly greater than a diameter of the top portion of the separate beverage container.

6. The snack food container of claim 5, wherein the receiving section defines a diameter in the range of approximately 52–55 mm.

7. The snack food container of claim 1, wherein the inner surface includes a first section adjacent the bottom wall and a second section extending from the first section, the first section being vertical.

8. The snack food container of claim 7, wherein the second section expands outwardly from the first section for guiding the snack food container onto a beverage container.

9. The snack food container of claim 1, wherein the flange body further comprises:

at least one retention tab extending in a generally radial fashion from the inner surface, the at least one retention tab being axially spaced from the bottom wall.

10. The snack food container of claim 9, wherein the at least one retention tab is configured to selectively engage a separate beverage container.

11. The snack food container of claim 9, further comprising:

a plurality of retention tabs circumferentially spaced along the inner surface.

12. The snack food container of claim 1, wherein the snack food container forms a slot extending from the side wall to the bottom wall, and further wherein the slot is configured to allow access to a beverage contained within the beverage container from an exterior of the side wall.

13. The snack food container of claim 12, wherein the slot is sized to allow passage of a straw.

14. The snack food container of claim 12, wherein the slot extends in an angular fashion from the bottom wall to the side wall.

15. The snack food container of claim 12, wherein the slot extends through the flange body.

16. The snack food container of claim 1, wherein the side wall, the bottom wall and the flange body are integrally formed.

17. The snack food container of claim 1, further comprising:

a protective film secured across the upper opening.

18. The snack food container of claim 1, further comprising:

a straw removably associated with the side wall.

19. A packaged good article comprising:

a snack food container comprising:

a side wall forming an upper opening, a bottom wall connected to the side wall opposite the upper opening, a flange body extending downwardly from the bottom wall, the flange body defining an inner surface and an outer surface, the inner surface being configured for selective attachment to a separate beverage container and characterized by the absence of threads, wherein the side wall and the bottom wall define an internal storage region; and a snack food product contained within the internal storage region apart from the inner surface of the flange body.

20. The packaged good article of claim 19, wherein the inner surface of the flange body is sized in accordance with a top portion of an available beverage container having a predetermined outer dimension.

21. The packaged good article of claim 20, wherein the available beverage container is cylindrical such that the predetermined outer dimension is a diameter.

22. The packaged good article of claim 21, wherein the inner surface is substantially annular.

23. The packaged good article of claim 19, wherein the inner surface includes a receiving section for interfacing with a top portion of the beverage container, the receiving section defining a diameter slightly greater than a diameter of the top portion of a separate beverage container.

24. The packaged good article of claim 23, wherein the receiving section defines a diameter in the range of approximately 52–55 mm.

25. The packaged good article of claim 19, wherein the inner surface includes a first section, adjacent the bottom wall and a second section extending from the first section, the first section being vertical.

26. The packaged good article of claim 24, wherein the second section expands outwardly from the first section for guiding the snack food container onto a beverage container.

27. The packaged good article of claim 19, wherein the flange body further comprises:

at least one retention tab extending in a generally radial fashion from the inner surface, the at least one retention tab being axially spaced from the bottom wall.

28. The packaged good article of claim 27, wherein the at least one retention tab is configured to selectively engage the separate beverage container.

29. The packaged good article of claim 27, further comprising:

a plurality of retention tabs circumferentially spaced along the inner surface.

30. The packaged good article of claim 19, wherein the snack food container forms a slot extending from the side wall to the bottom wall, and further wherein the slot is configured to allow access to a beverage contained within the beverage container from an exterior of the side wall.

31. The packaged good article of claim 30, wherein the slot is sized to allow passage of a straw.

32. The packaged good article of claim 30, wherein the slot extends in an angular fashion from the bottom wall to the side wall.

33. The packaged good article of claim 30, wherein the slot extends through the flange body.

34. The packaged good article of claim 19, wherein the side wall, the bottom wall and the flange body are integrally formed.

35. The packaged good article of claim 19, further comprising:

a protective film secured across the upper opening.

36. The packaged good article of claim 19, further comprising:

a straw removably associated with the side wall.

37. The packaged good article of claim 19, wherein the snack food product includes a plurality of dried food items.

38. A snack food container comprising:

a side wall forming an upper opening;

a bottom wall connected to the side wall opposite the upper opening;

a flange body extending downwardly from the bottom wall; and retaining means associated with the flange body for selectively attaching the snack food container to a separate beverage container, the retaining means characterized by the absence of threads;

wherein the side wall, the bottom wall, the flange body and the retaining means are homogenous and integrally formed, and form an internal storage region for containing a snack food product apart from the retaining means.

39. The snack food container of claim 38, wherein the retaining means includes a substantially annular surface formed by the flange body, the substantially annular surface having a diameter approximating a diameter of an available cylindrical beverage container.

40. The snack food container of claim 38, further comprising:

a slot extending from the side wall to the bottom wall configured to provide access to a beverage contained within the beverage container from an exterior of the side wall.

41. The snack food container of claim 40, wherein the slot extends through the flange body.

42. The snack food container of claim 38, further comprising:

a protective film sealed across the upper opening.

43. A snack food container comprising:

a side wall forming an upper opening;

a bottom wall connected to the side wall opposite the upper opening; and a flange body extending downwardly from the bottom wall, the flange body defining an inner surface and an outer surface, the inner surface being configured for selective attachment to a beverage container and characterized by the absence of threads, the flange body further comprising:

at least one retention tab extending in a generally radial fashion from the inner surface, the at least one retention tab being axially spaced from the bottom wall;

wherein the snack food container defines an internal storage region for containing a snack food product, the internal storage region being formed apart from the inner surface of the flange body.

44. The snack food container of claim 43, wherein the at least one retention tab is configured to selectively engage a separate beverage container.

45. The snack food container of claim 43, further comprising:

a plurality of retention tabs circumferentially spaced along the inner surface.

46. A packaged good article comprising:

a snack food container comprising:

a side wall forming an upper opening, a bottom wall connected to the side wall opposite the upper opening, a flange body extending downwardly from the bottom wall, the flange body defining an inner surface and an outer surface, the inner surface being configured for selective attachment to a separate beverage container and characterized by the absence of threads, the flange body further comprising:

at least one retention tab extending in a generally radial fashion from the inner surface, the at least one retention tab being axially spaced from the bottom wall, wherein the snack food container defines an internal storage region; and a snack food product contained within the internal storage region apart from the inner surface of the flange body.

47. The packaged good article of claim 46, wherein the at least one retention tab is configured to selectively engage the separate beverage container.

48. The packaged good article of claim 46, further comprising:

a plurality of retention tabs circumferentially spaced along the inner surface.

* * * * *